US010500740B1

(12) United States Patent
Marfione et al.

(10) Patent No.: US 10,500,740 B1
(45) Date of Patent: Dec. 10, 2019

(54) SWITCHBLADE

(71) Applicants: Anthony Louis Marfione, Fletcher, NC (US); Anthony Gary Marfione, Fletcher, NC (US)

(72) Inventors: Anthony Louis Marfione, Fletcher, NC (US); Anthony Gary Marfione, Fletcher, NC (US)

(73) Assignee: Microtech Knives, Inc., Bradford, PA (US)

( * ) Notice: Subject to any disclaimer, the term of this patent is extended or adjusted under 35 U.S.C. 154(b) by 0 days.

(21) Appl. No.: 16/435,168

(22) Filed: Jun. 7, 2019

(51) Int. Cl.
*B26B 1/08* (2006.01)
*B26B 9/02* (2006.01)
*B26B 1/10* (2006.01)

(52) U.S. Cl.
CPC *B26B 1/08* (2013.01); *B26B 1/10* (2013.01); *B26B 9/02* (2013.01)

(58) Field of Classification Search
CPC ..... B26B 1/08; B26B 9/02; B26B 1/10
See application file for complete search history.

(56) References Cited

U.S. PATENT DOCUMENTS 2,854,745 A * 10/1958 Braverman ..... B26B 1/08 30/162
7,305,769 B2 * 12/2007 McHenry ..... B26B 1/08 30/162
7,562,455 B2 7/2009 McHenry
7,574,804 B2 8/2009 Bezold
7,797,838 B2 * 9/2010 Chu ..... B26B 1/08 30/151
8,402,663 B2 * 3/2013 McHenry ..... B26B 1/08 30/162
8,595,941 B2 * 12/2013 Lee ..... B26B 1/08 30/151
8,671,578 B1 3/2014 Frazer
8,966,771 B2 * 3/2015 Chu ..... B26B 1/08 30/162
9,375,854 B2 6/2016 Chu
9,498,889 B1 11/2016 Hawk
9,676,105 B2 * 6/2017 McChesney ..... B26B 1/08
D796,932 S 9/2017 Sung
9,764,485 B1 9/2017 Hawk
D810,540 S 2/2018 Marfione
10,220,527 B1 3/2019 Marfione
2012/0255179 A1 * 10/2012 Moizis ..... B26B 1/08 30/162

(Continued)

*Primary Examiner* — Hwei-Siu C Payer
(74) *Attorney, Agent, or Firm* — Steve LeBlanc, LLC

(57) ABSTRACT

A switchblade includes a casing that defines a cavity. A blade having a cutting edge has a retracted position in which the cutting edge is inside the cavity and a deployed position in which the cutting edge is outside of the cavity. An actuator is slidably engaged with the casing. A slider inside the cavity defines a tab on a first side of the slider and engaged with the actuator and front and rear sloped surfaces on a second side of the slider. A front operator and a rear operator are inside the cavity, and a spring connects the front operator to the rear operator. A front lock on the second side of the slider inside the cavity is engaged with the blade in the deployed position. A rear lock on the second side of the slider inside the cavity is engaged with the blade in the retracted position.

20 Claims, 7 Drawing Sheets

(56) References Cited

U.S. PATENT DOCUMENTS

| | | | | |
|---|---|---|---|---|
| 2014/0101943 | A1* | 4/2014 | Chu | B26B 1/08 30/162 |
| 2014/0173911 | A1* | 6/2014 | Chu | B26B 1/08 30/162 |
| 2014/0208596 | A1* | 7/2014 | Constantine | B26B 1/08 30/162 |

* cited by examiner

SWITCHBLADE

FIELD OF THE INVENTION

The present invention generally involves a switchblade. In particular embodiments, the switchblade may be a double action, out-the-front configuration.

BACKGROUND OF THE INVENTION

Pocket knives provide a convenient tool for cutting that may be easily carried by a user for deployment when desired. For some pocket knife designs, two hands are needed to deploy and retract a blade, while other designs include a spring that assists a user to deploy or retract the blade using a single hand. Each design balances the convenience and speed of operation with increased risk associated with inadvertent operation.

A switchblade is a particular style of pocket knife that has a folding or sliding blade that automatically deploys when an actuator is operated. A single action switchblade typically includes a spring under tension with the blade when retracted, and operation of the actuator releases the blade to allow the spring tension to automatically deploy the blade. Once deployed, the actuator is released to hold the blade in the deployed position. To retract a single action switchblade, the actuator is again operated to release the blade, and the blade must be manually retracted against the spring tension. For example, a single action switchblade design may include a charging handle that may be manually operated to retract the blade against the spring tension. In contrast, a double action switchblade typically includes a slider engaged with the actuator, front and rear operators connected by a spring to alternately engage with the blade and slider, and front and rear locks engaged with the blade in the deployed and retracted positions, respectively. To deploy a double action switchblade, the actuator is moved forward to move the slider forward. Forward movement of the slider moves the front operator forward while the rear operator is engaged with the rear of the blade to charge the spring. Forward movement of the slider eventually releases the rear lock to allow the charged spring to deploy the blade, and the front lock engages with the deployed blade to lock the blade in the deployed position. To retract a double action switchblade, the actuator is moved rearward to move the slider rearward. Rearward movement of the slider moves the rear operator rearward while the front operator is engaged with the blade to charge the spring. Rearward movement of the slider eventually releases the front lock to allow the charged spring to retract the blade, and the rear lock engages with the retracted blade to lock the blade in the retracted position.

Although a double action switchblade provides convenient one-handed operation, the slider that provides this convenient functionality generally requires precise manufacturing tolerances to achieve the required clearances inside the switchblade while ensuring years of reliable operation. The precise manufacturing tolerances increase the cost of the switchblade, as well as the cost of replacement parts and repairs. In addition, the conventional arrangement of the slider, front and rear operators, spring, and front and rear locks inside the switchblade increases the size of the switchblade to ensure adequate clearance between the components as they move. Therefore, the need exists for an improved switchblade that does not require a precisely machined slider and that can provide the desired functionality in a smaller casing.

BRIEF DESCRIPTION OF THE INVENTION

Aspects and advantages of the invention are set forth below in the following description, or may be obvious from the description, or may be learned through practice of the invention.

One embodiment of the present invention is a switchblade that includes a casing that defines a cavity. A blade having a cutting edge has a retracted position in which the cutting edge is inside the cavity and a deployed position in which the cutting edge is outside of the cavity. An actuator is slidably engaged with the casing. A slider inside the cavity of the casing defines a tab on a first side of the slider and engaged with the actuator, a front sloped surface on a second side of the slider opposite the first side, and a rear sloped surface on the second side of the slider. A front operator and a rear operator are inside the cavity, and a spring connects the front operator to the rear operator. A front lock on the second side of the slider inside the cavity is engaged with the blade in the deployed position. A rear lock on the second side of the slider inside the cavity is engaged with the blade in the retracted position.

An alternate embodiment of the present invention is a switchblade that includes a casing that defines a cavity. A blade having a cutting edge has a retracted position in which the cutting edge is inside the cavity and a deployed position in which the cutting edge is outside of the cavity. A front operator inside the cavity engages with the blade to move the blade to the retracted position. A rear operator inside the cavity engages with the blade to move the blade to the deployed position. A spring connects the front operator to the rear operator. An actuator is slidably engaged with the casing. A slider inside the cavity of the casing defines a tab on a first side of the slider and engaged with the actuator, a front sloped surface on a second side of the slider opposite the first side, and a rear sloped surface on the second side of the slider. The slider has a uniform thickness between the first side and the second side.

In yet another embodiment of the present invention, a switchblade includes a casing that defines a cavity. A blade having a cutting edge has a retracted position in which the cutting edge is inside the cavity and a deployed position in which the cutting edge is outside of the cavity. An actuator is slidably engaged with the casing. A slider inside the cavity of the casing defines a tab on a first side of the slider and engaged with the actuator, a front sloped surface on a second side of the slider opposite the first side, and a rear sloped surface on the second side of the slider. A front operator inside the cavity engages with the slider to move the blade to the deployed position. A rear operator inside the cavity engages with the slider to move the blade to the retracted position. A spring connects the front operator to the rear operator. A front lock on the second side of the slider inside the cavity is engaged with the blade in the deployed position. A rear lock on the second side of the slider inside the cavity is engaged with the blade in the retracted position Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
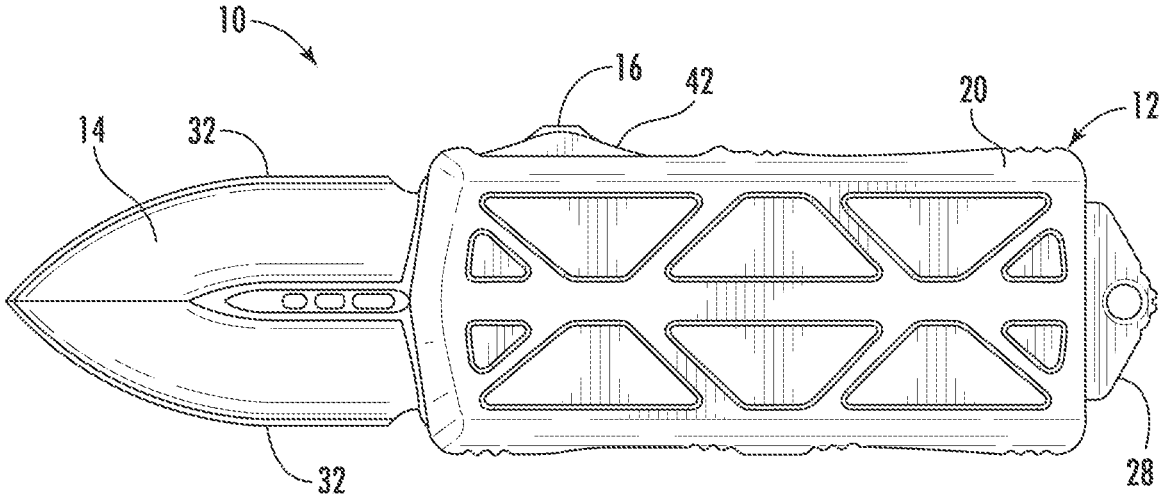
FIG. 1 is a top plan view of a switchblade according to one embodiment of the present invention with the blade in a deployed position.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Embodiments of the present invention include a switchblade with internal components that may be manufactured without requiring precise machining normally associated with conventional switchblades. In addition, embodiments of the present invention arrange the components inside the switchblade in a manner that provides the same functionality as conventional switchblades in a smaller volume, reducing the size of the switchblade. As used herein, the term "front" shall refer to the end of the switchblade from which a blade deploys, and the term "rear" shall refer to the opposite end of the switchblade. As used herein, the term "longitudinal" shall refer to the direction between the front and rear of the switchblade.

Figure 2:
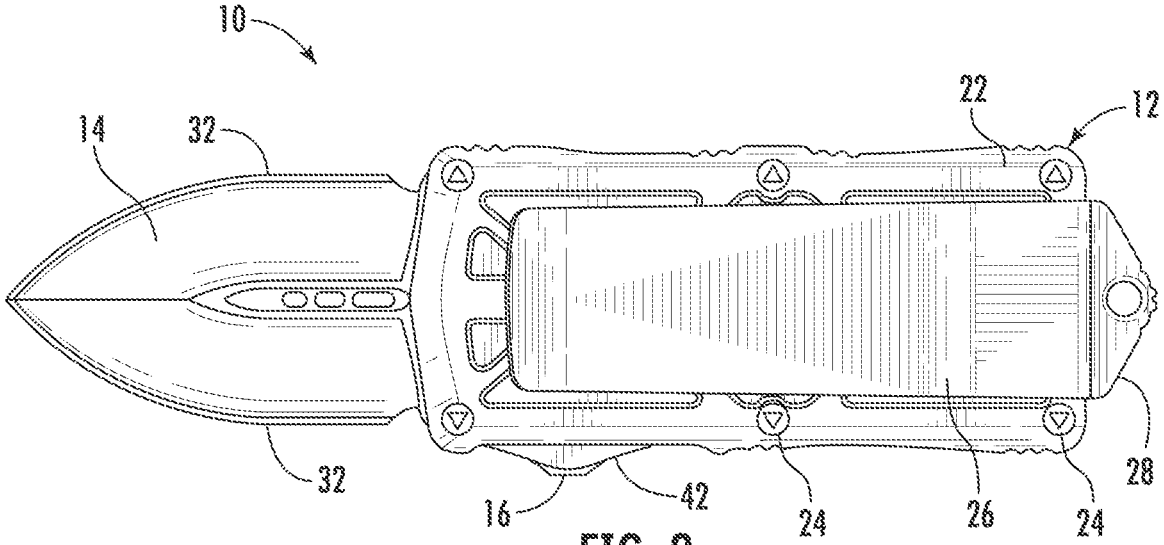
FIG. 2 is a bottom plan view of the switchblade shown in FIG. 1 with the blade in the deployed position.
Figure 3:
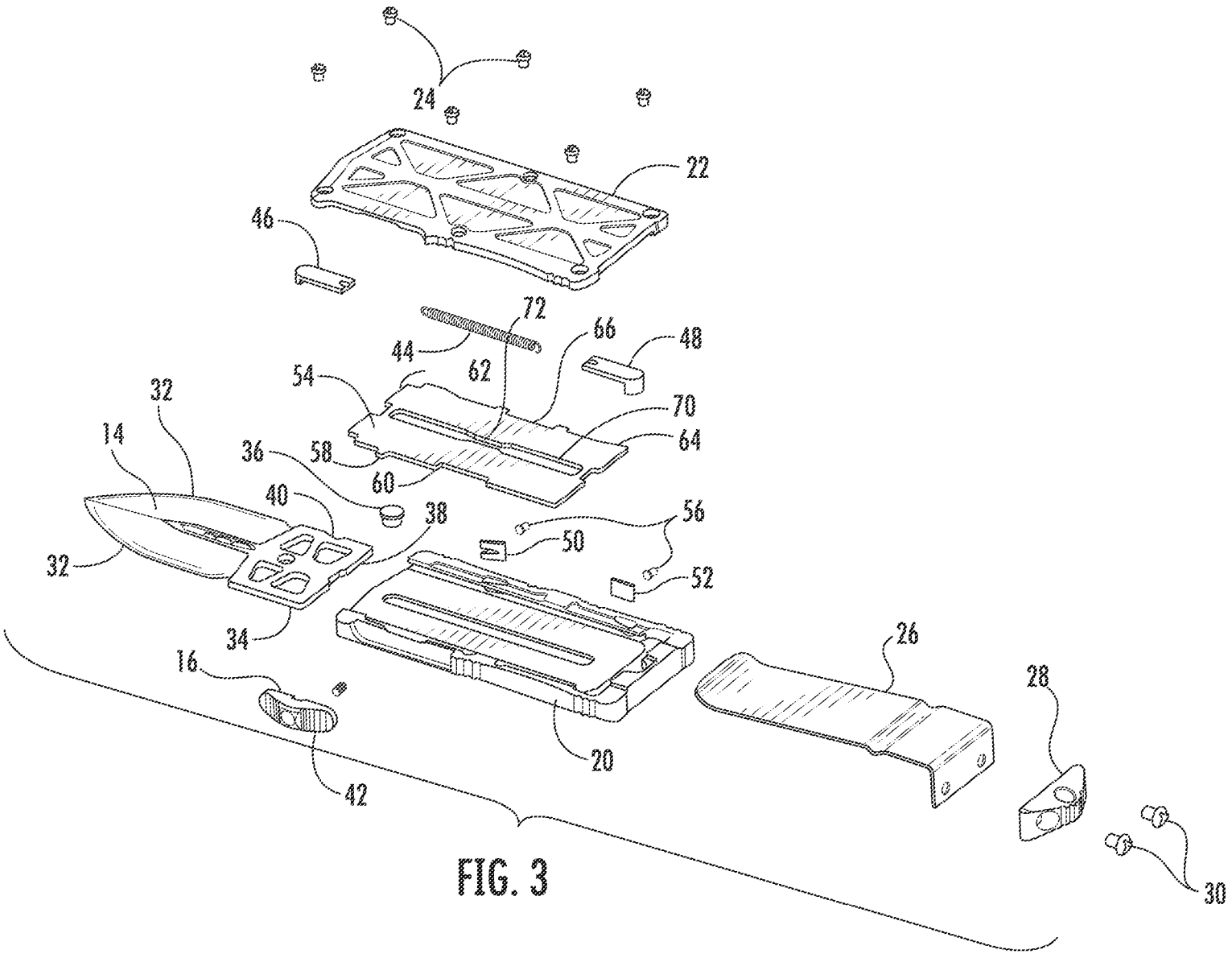
FIG. 3 is an exploded view of the switchblade shown in FIG. 1.
Figure 4:
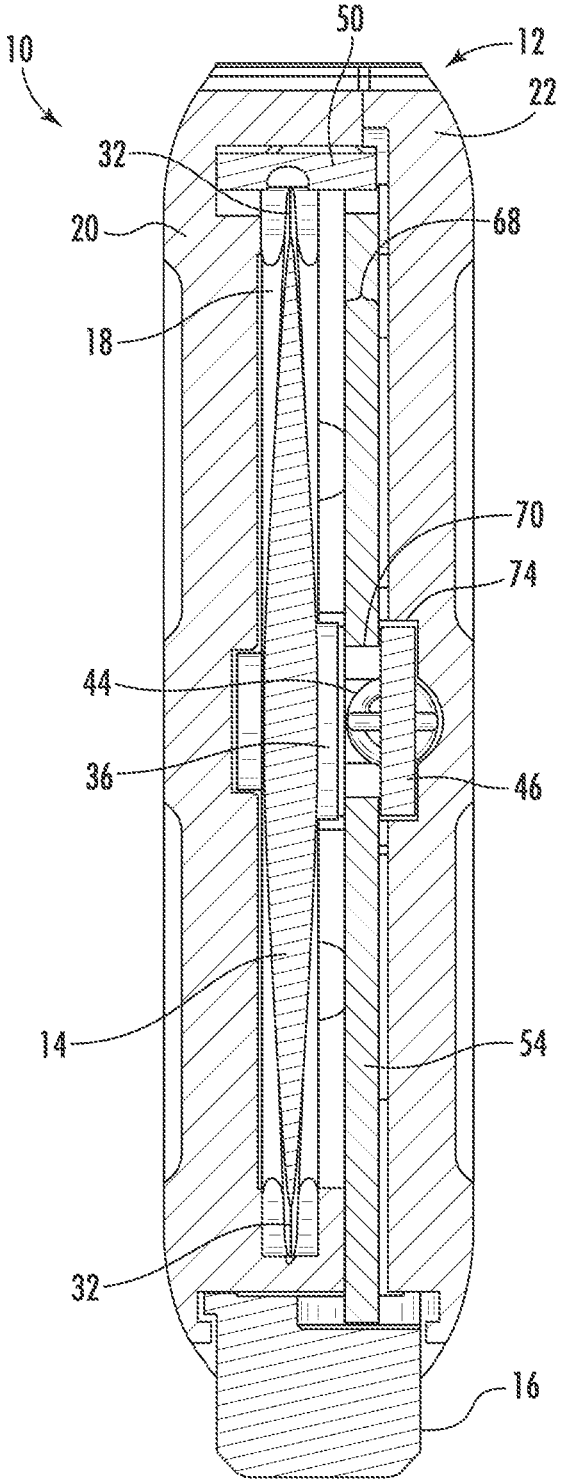
FIG. 4 is a cross-section view of the switchblade in a retracted position taken along line A-A of FIG. 5.

FIGS. 1 and 2 provide top and bottom plan views, respectively, of a switchblade 10 according to one embodiment of the present invention in a deployed position. FIG. 3 provides an exploded view of the switchblade 10 shown in FIGS. 1 and 2, and FIG. 4 provides a cross-section view of the switchblade 10 taken along line A-A of FIG. 5 in a retracted position. As shown in FIGS. 1 and 2, the switchblade generally includes a casing 12, a blade 14, and an actuator 16. The casing 12 defines a cavity 18 (shown in FIG. 4) that contains the various components for operating the switchblade 10. The casing 12 may include a top scale 20 connected to a bottom scale 22 by screws 24 or other attachment means. In the particular embodiment shown in FIGS. 1-3, the screws 24 may be inserted through the bottom scale 22 to provide threaded engagement with the top scale 20 without passing through the top scale 20, resulting in a visually clean appearance of the top scale 20 of the casing 12. Similarly, the switchblade may include an optional pocket clip 26 and glass break 28 attached by screws 30 to the rear of the casing 12 so that the pocket clip 26 extends over the bottom scale 22, while the top scale 20 remains relatively unadorned.

Figure 5:
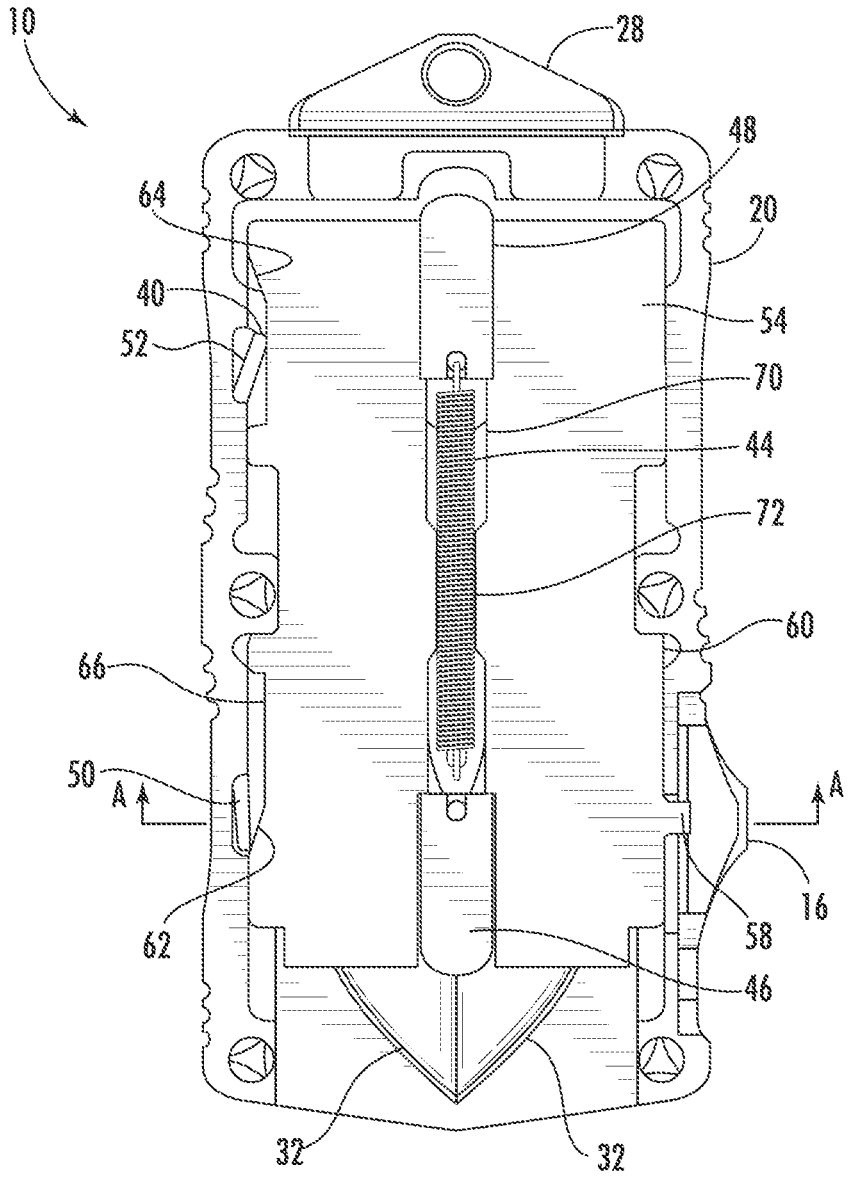
FIG. 5 is a bottom plan view of the switchblade shown in FIG. 1 in a retracted position with the bottom scale and pocket clip removed, the actuator in the retracted position, and the rear lock engaged with the blade.
Figure 6:
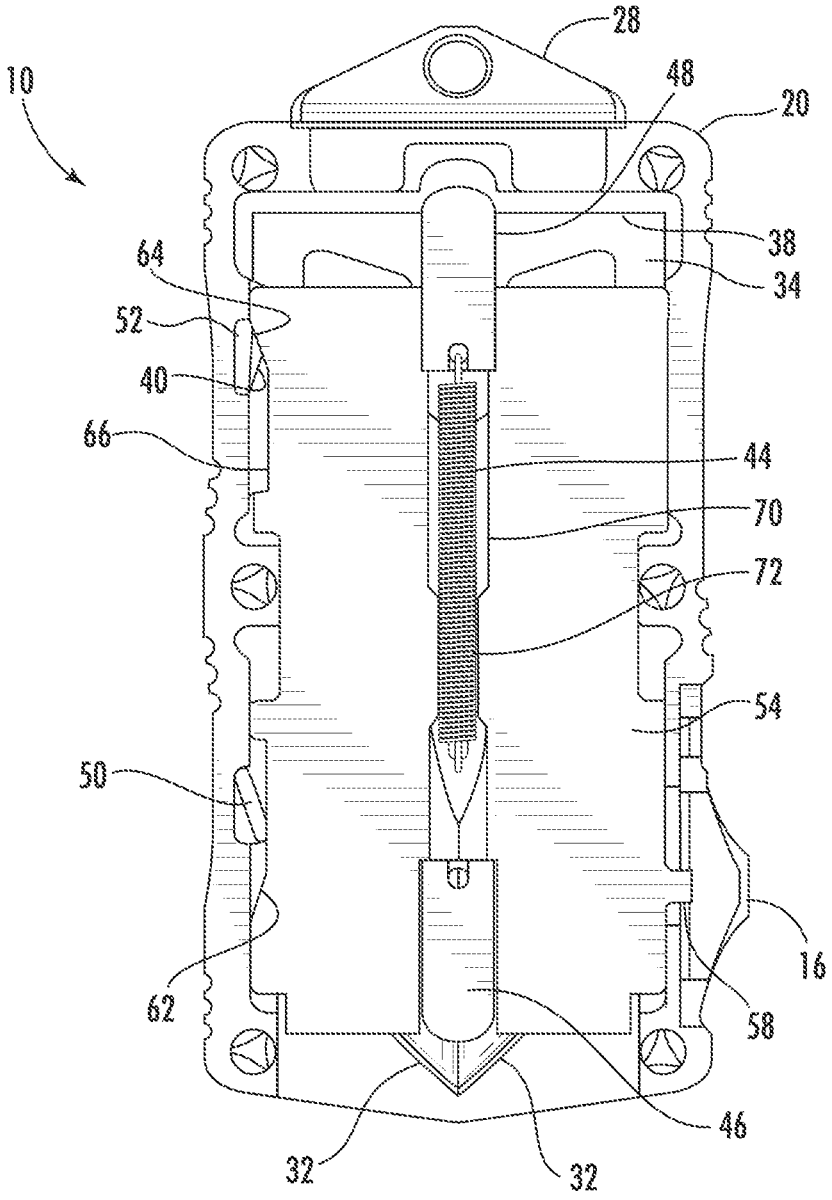
FIG. 6 is a bottom plan view of the switchblade shown in FIG. 1 in the retracted position with the bottom scale and pocket clip removed, the actuator in the deployed position, and the rear lock released from the blade.

The blade 14 generally has one or more cutting edges 32 and a tang 34, and the blade 14 can move between the deployed position and the retracted position. In the deployed position, as shown in FIGS. 1-3, 7, and 8, the cutting edges 32 are outside of the cavity 18 of the casing 12 to allow use of the cutting edges 32 as desired. In the retracted position, as shown in FIGS. 4-6, the cutting edges 32 are inside the cavity 18 of the casing 12 to shield the cutting edges 32 from inadvertent contact that might damage the blade 14 or cause harm to personnel or objects. As shown in FIG. 3, the tang 34 of the blade 14 may include a post 36 longitudinally separated from a rear surface 38 and a notch 40 in one or both sides. In particular embodiments, the post 36 may be simply a projection from the tang 34, while in other embodiments, as shown in FIG. 3, the post 36 may be a separate part threaded or press-fit into the tang 34. The purpose and operation of the post 36, rear surface 38, and notch 38 will be described in more detail with respect to operation of the blade between the retracted and deployed positions as shown in FIGS. 5-8.

The actuator 16 is slidably engaged with the casing 12 to reposition the blade 14 between the retracted and deployed positions. As such, the actuator 16 may include opposing sloped surfaces 42 that facilitate sliding the actuator 16 forward to deploy the blade 14 and rearward to retract the blade 14.

As shown most clearly in FIGS. 3 and 4, a spring 44, front and rear operators 46, 48, front and rear locks 50, 52, and a slider 54 are located inside the cavity 18 of the casing 12. The spring 44 connects the front operator 46 to the rear operator 48. As will be explained in more detail with respect to FIGS. 5-8, the front and rear operators 46, 48 alternately engage with the blade 14 and slider 54 to move the blade 14 between the retracted and deployed positions. The front and rear locks 50, 52 are pivotally connected to the casing 12 and biased inward in the cavity 18 by springs 56. In the retracted position, the rear lock 52 is in biased engagement with the notch 40 in the tang 34 to retain the blade 14 inside the casing 12. In the deployed position, the front lock 50 is in biased engagement with the rear surface 38 of the tang 34 to hold the blade 14 outside of the casing 12.

The slider 54 defines a tab 58 on a first side 60 and front and rear sloped surfaces 62, 64 on a second side 66 opposite the first side 60. The tab 58 is engaged with the actuator 16 so that forward or rearward movement of the actuator 16 moves the slider 54 the same direction and distance. Forward movement of the actuator 16 and slider 54 causes the rear sloped surface 64 to engage with the rear lock 52 to pivot the rear lock 52 outward, disengaging the rear lock 52 from the notch 40 in the tang 34 to allow the blade 14 to move to the deployed position. Conversely, rearward movement of the actuator 16 and slider 54 causes the front sloped surface 62 to engage with the front lock 50 to pivot the front lock 50 outward, disengaging the front lock 50 from the rear surface 38 of the tang 34 to allow the blade 14 to move to the retracted position.

FIGS. 3 and 4 most clearly illustrate additional features of embodiments of the present invention that simplify manufacturing costs and reduce the size of the casing 12. As shown in FIGS. 3 and 4, for example, the slider 54 may have a uniform thickness 68 between the first side 60 and the second side 66 to facilitate manufacturing while also allowing the slider 54 to move longitudinally inside the cavity 18 without interfering with the other components inside the cavity 18. Alternately or in addition, the slider 54 may define a longitudinal channel 70 through the slider 54 between the first and second sides 60, 66, and the longitudinal channel 70 may include a longitudinal midpoint 72 with a reduced width. As shown in FIG. 4, at least a portion of the spring 44 may be located in the longitudinal channel 70, and the reduced width at the longitudinal midpoint 72 may damp vibrations of the spring 44 during operation of the switchblade 10. As further shown in FIG. 4, the bottom scale 22 of the casing 12 may define a longitudinal recess 74, and at least a portion of the spring 44, front operator 46, and rear operator 48 may reside in the longitudinal recess 74. In this manner, the longitudinal channel 70 in the slider 54 and the longitudinal recess 74 in the casing 12 combine to allow a thinner casing 12 to accommodate the various components inside the casing 12.

Operation of the switchblade 10 between the retracted and deployed positions will now be described with respect to FIGS. 5-8. As shown in FIG. 5, the actuator 16 is in the rearward or retracted position with the blade 14 retracted inside the cavity 18. In the retracted position, the rear operator 48 is engaged with the rear surface 38 of the tang 34, and the rear lock 52 is engaged with the notch 40 in the tang 34 to retain the blade 14 in the retracted position.

To deploy the blade 14, the actuator 16 is moved to the forward or deployed position as shown in FIG. 6, and the engagement between the tab 58 of the slider 54 and the actuator 16 causes the slider 54 to move forward with the actuator 16. As the slider 54 initially moves forward, the rear lock 52 remains engaged with the notch 40 in the tang 34 to prevent the blade 14 from moving, and the front of the slider 54 engages with the front operator 46 to move the front operator 46 forward and create tension in the spring 44 between the front and rear operators 46, 48. Eventually, the rear sloped surface 64 on the second side 66 of the slider 54 disengages the rear lock 52 from the notch 40 to release the blade 14, as shown in FIG. 6.

Figure 7:
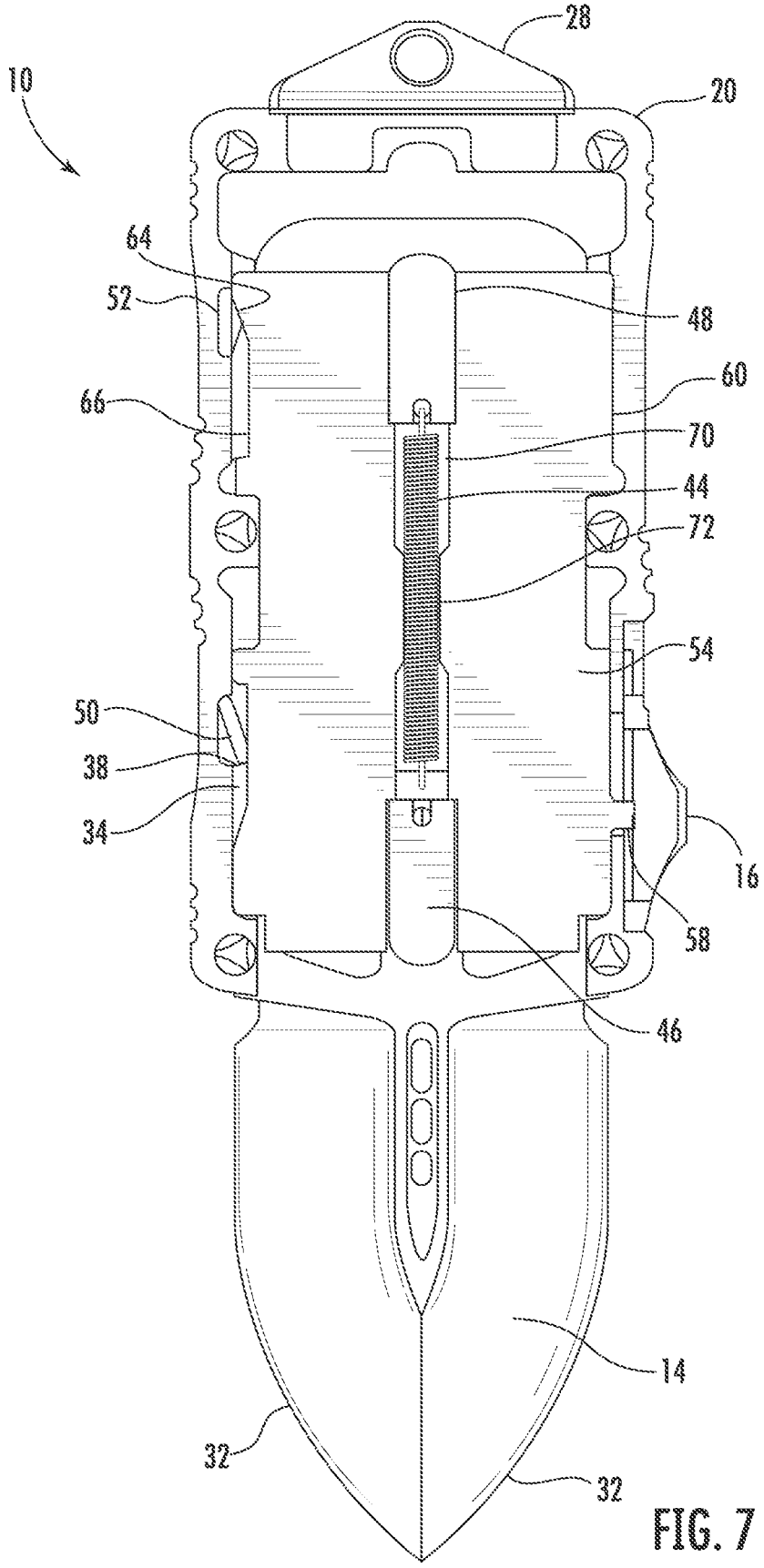
FIG. 7 is a bottom plan view of the switchblade shown in FIG. 1 in the deployed position with the bottom scale and pocket clip removed, the actuator in the deployed position, and the front lock engaged with the blade.

When the rear lock 52 disengages from the notch 40, the tension in the spring 44 causes the rear operator 48 to eject the blade 14 out of the cavity 18 to the deployed position, as shown in FIG. 7. The blade 14 moves out of the cavity 18 until the post 36 of the slider 54 contacts the front operator 46 to prevent further travel of the blade 14 out of the cavity 18. As shown in FIG. 7, the actuator 16 is in the forward or deployed position with the blade 14 deployed outside of the cavity 18. In the deployed position, the front operator 46 is engaged with the post 36 of the slider 54, and the front lock 50 is engaged with the rear surface 38 of the tang 34 to hold the blade 14 in the deployed position.

Figure 8:
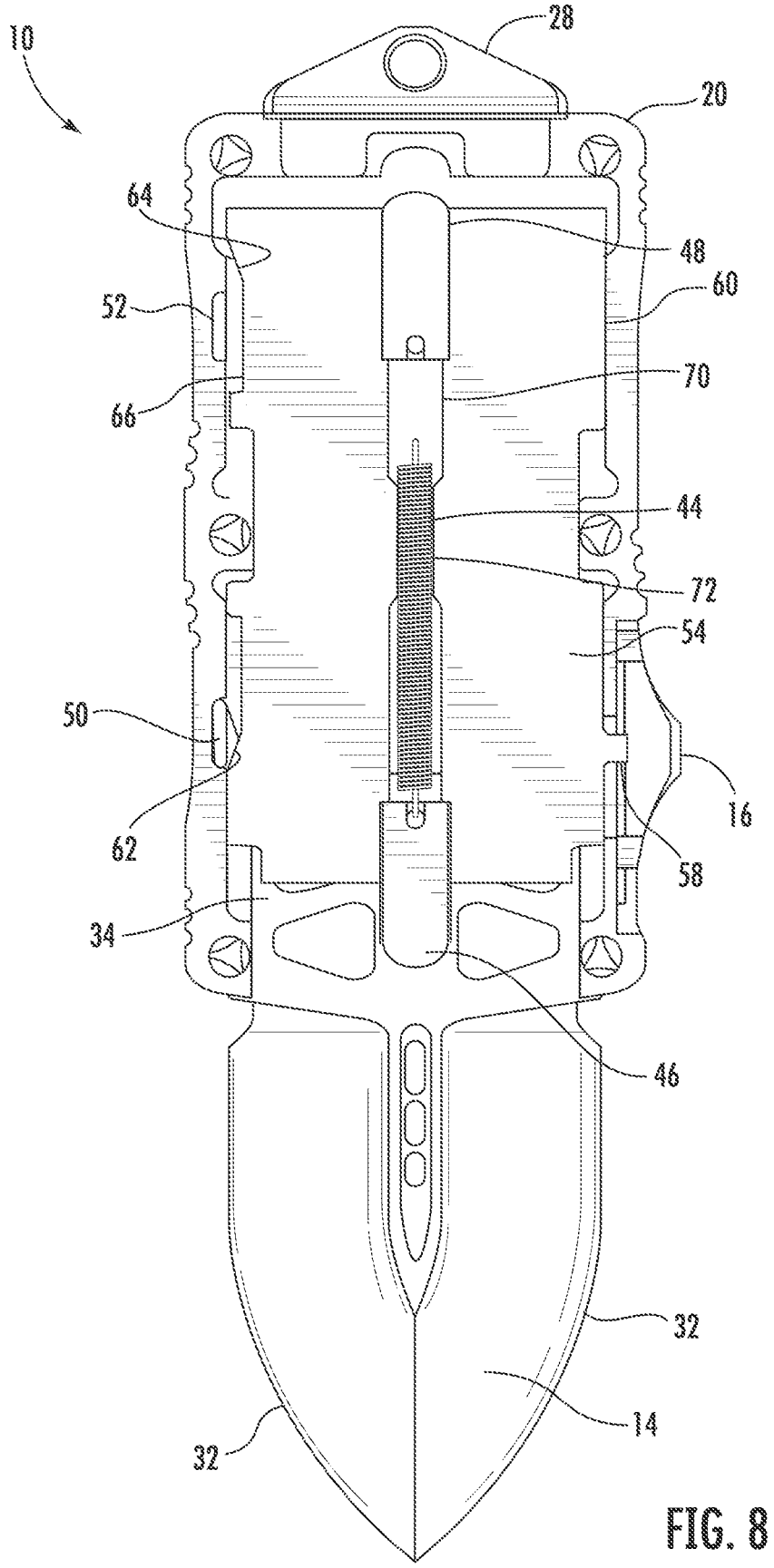
FIG. 8 is a bottom plan view of the switchblade shown in FIG. 1 in the deployed position with the bottom scale and pocket clip removed, the actuator in the retracted position, and the front lock released from the blade.

To retract the blade 14, the actuator 16 is moved to the rearward or retracted position as shown in FIG. 8, and the engagement between the tab 58 of the slider 54 and the actuator 16 causes the slider 54 to move rearward with the actuator 16. As the slider 54 initially moves rearward, the front lock 50 remains engaged with the rear surface 38 of the tang 34 to prevent the blade 14 from moving, and the rear of the slider 54 engages with the rear operator 48 to move the rear operator 48 rearward and create tension in the spring 44 between the front and rear operators 46, 48. Eventually, the front sloped surface 62 on the second side 66 of the slider 54 disengages the front lock 50 from the rear surface 38 of the tang 34 to release the blade 14, as shown in FIG. 8.

When the front lock 50 disengages from the rear surface 38 of the tang 34, the tension in the spring 44 causes the front operator 46 to retract the blade 14 into the cavity 18 to the retracted position, as shown in FIG. 5. The blade 14 moves into the cavity 18 until the rear surface 38 of the tang 34 contacts the rear operator 48 and the rear lock 52 again engages with the notch 40 in the tang 34 to retain the blade 14 in the retracted position.

The embodiments described and illustrated with respect to FIGS. 1-8 provide several advantages over conventional double action switchblades. For example, locating the front and rear locks 50, 52 on the same side 66 of the slider 54 prevents the front lock 50 from interfering with longitudinal movement of the slider 54 when moving between the retracted and deployed positions. As a result, the slider 54 may have a uniform thickness 68 between the first and second sides 60, 66, simplifying the manufacture of the slider 54 and reducing manufacturing and repair costs. In addition, the longitudinal channel 70 in the slider 54 and the longitudinal recess 74 in the bottom scale 22 allows the slider 54, spring 44, and front and rear operators 46, 48 to fit in a smaller cavity 18, reducing the size of the casing 12.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A switchblade, comprising:

a casing, wherein said casing defines a cavity;

a blade having a cutting edge, wherein said blade has a retracted position in which said cutting edge is inside said cavity and a deployed position in which said cutting edge is outside of said cavity;

an actuator slidably engaged with said casing;

a slider inside said cavity of said casing, wherein said slider defines a tab on a first side of said slider and engaged with said actuator, a front sloped surface on a second side of said slider opposite said first side, and a rear sloped surface on said second side of said slider;

a front operator inside said cavity;

a rear operator inside said cavity;

a spring connecting said front operator to said rear operator;

a front lock on said second side of said slider inside said cavity engaged with said blade in said deployed position; and a rear lock on said second side of said slider inside said cavity engaged with said blade in said retracted position.

2. The switchblade as in claim 1, wherein said casing defines a longitudinal recess, and at least a portion of the front operator, the rear operator, and the spring reside in said longitudinal recess of said casing.

3. The switchblade as in claim 1, wherein said slider has a uniform thickness between said first side and said second side.

4. The switchblade as in claim 1, wherein said slider defines a longitudinal channel through said slider between said first and second sides, and at least a portion of said spring is located in said longitudinal channel.

5. The switchblade as in claim 4, wherein said longitudinal channel has a longitudinal midpoint with a reduced width.

6. The switchblade as in claim 1, wherein said rear operator engages with said blade to move said blade to said deployed position, and said front operator engages with said blade to move said blade to said retracted position.

7. The switchblade as in claim 1, wherein said rear sloped surface on said second side of said slider disengages said rear lock from said blade to allow said blade to move to said deployed position, and said front sloped surface on said second side of said slider disengages said front lock from said blade to allow said blade to move to said retracted position.

8. A switchblade, comprising:

a casing, wherein said casing defines a cavity;

a blade having a cutting edge, wherein said blade has a retracted position in which said cutting edge is inside said cavity and a deployed position in which said cutting edge is outside of said cavity;

a front operator inside said cavity, wherein said front operator engages with said blade to move said blade to said retracted position;

a rear operator inside said cavity, wherein said rear operator engages with said blade to move said blade to said deployed position;

a spring connecting said front operator to said rear operator;

an actuator slidably engaged with said casing, a slider inside said cavity of said casing, wherein said slider defines a tab on a first side of said slider and engaged with said actuator, a front sloped surface on a second side of said slider opposite said first side, and a rear sloped surface on said second side of said slider; and wherein said slider has a uniform thickness between said first side and said second side.

9. The switchblade as in claim 8, wherein said casing defines a longitudinal recess, and at least a portion of the front operator, the rear operator, and the spring reside in said longitudinal recess of said casing.

10. The switchblade as in claim 8, wherein said slider defines a longitudinal channel through said slider between said first and second sides, and at least a portion of said spring is located in said longitudinal channel.

11. The switchblade as in claim 10, wherein said longitudinal channel has a longitudinal midpoint with a reduced width.

12. The switchblade as in claim 8, wherein said rear operator engages with said slider to move said blade to said retracted position, and said front operator engages with said slider to move said blade to said deployed position.

13. The switchblade as in claim 8, further comprising a front lock on said second side of said slider inside said cavity engaged with said blade in said deployed position, and a rear lock on said second side of said slider inside said cavity engaged with said blade in said retracted position.

14. The switchblade as in claim 13, wherein said front sloped surface on said second side of said slider disengages said front lock from said blade to allow said blade to move to said retracted position, and said rear sloped surface on said second side of said slider disengages said rear lock from said blade to allow said blade to move to said deployed position.

15. A switchblade, comprising:

a casing, wherein said casing defines a cavity;

a blade having a cutting edge, wherein said blade has a retracted position in which said cutting edge is inside said cavity and a deployed position in which said cutting edge is outside of said cavity;

an actuator slidably engaged with said casing;

a slider inside said cavity of said casing, wherein said slider defines a tab on a first side of said slider and engaged with said actuator, a front sloped surface on a second side of said slider opposite said first side, and a rear sloped surface on said second side of said slider; and a front operator inside said cavity, wherein said front operator engages with said slider to move said blade to said deployed position;

a rear operator inside said cavity, wherein said rear operator engages with said slider to move said blade to said retracted position;

a spring connecting said front operator to said rear operator;

a front lock on said second side of said slider inside said cavity engaged with said blade in said deployed position; and a rear lock on said second side of said slider inside said cavity engaged with said blade in said retracted position.

16. The switchblade as in claim 15, wherein said casing defines a longitudinal recess, and at least a portion of the front operator, the rear operator, and the spring reside in said longitudinal recess of said casing.

17. The switchblade as in claim 15, wherein said slider defines a longitudinal channel through said slider between said first and second sides, and at least a portion of said spring is located in said longitudinal channel.

18. The switchblade as in claim 17, wherein said longitudinal channel has a longitudinal midpoint with a reduced width.

19. The switchblade as in claim 15, wherein said rear operator engages with said blade to move said blade to said deployed position, and said front operator engages with said blade to move said blade to said retracted position.

20. The switchblade as in claim 15, wherein said rear sloped surface on said second side of said slider disengages said rear lock from said blade to allow said blade to move to said deployed position, and said front sloped surface on said second side of said slider disengages said front lock from said blade to allow said blade to move to said retracted position.

* * * * *